United States Patent [19]

Kurahashi

[11] 4,306,599

[45] Dec. 22, 1981

[54] CHANGE-OVER MECHANISM FOR OPERATING SCREWDRIVER IN AUTOMATIC OR LATCHED STATE

[76] Inventor: Akihiko Kurahashi, 12-10, Sekime 2-chome, Joto-ku, Osaka, Japan

[21] Appl. No.: 12,556

[22] Filed: Feb. 15, 1979

[30] Foreign Application Priority Data

Feb. 18, 1978 [JP] Japan ..... 53-20015[U]

[51] Int. Cl.[3] ..... B25B 17/00

[52] U.S. Cl. ..... 145/54

[58] Field of Search ..... 145/53, 54

[56] References Cited

U.S. PATENT DOCUMENTS

| | | | |
|---|---|---|---|
| 568,341 | 9/1896 | Edwards et al. | 145/54 |
| 924,372 | 6/1909 | Peck | 145/54 |
| 1,054,142 | 2/1913 | Plein | 145/53 |
| 1,118,250 | 11/1914 | Wilder | 145/54 |
| 1,304,714 | 5/1919 | Starrett | 145/54 |
| 1,578,866 | 3/1926 | Swain | 145/53 |
| 2,947,334 | 8/1960 | Issartel | 145/54 |

FOREIGN PATENT DOCUMENTS

| | | | |
|---|---|---|---|
| 18254 | of 1891 | United Kingdom | 145/53 |

*Primary Examiner*—Stephen G. Kunin
*Assistant Examiner*—J. T. Zatarga
*Attorney, Agent, or Firm*—Wenderoth, Lind & Ponack

[57] ABSTRACT

A screwdriver main body supports a shank which is axially slidable and rotatable with respect thereto. A change-over ring supports a latch pawl which is turnable by its engagement with the ring mechanism. The pawl, when turned inward, locks the shank and prevents it from axial, slidable and rotatable movement with respect to the main body.

5 Claims, 8 Drawing Figures

CHANGE-OVER MECHANISM FOR OPERATING SCREWDRIVER IN AUTOMATIC OR LATCHED STATE

BACKGROUND OF THE INVENTION

The present invention relates to a screwdriver comprising a screwdriver shank which is selectively retainable in an automatic state or in a latched state to automatically tighten or loosen screws merely when the handle portion of the screwdriver is pushed against a screw, or to manually tighten or loosen screws when the handle portion is turned respectively.

Ideally screwdrivers of this type should have the following features:

First, the screwdriver shank should be axially movable forward and backward while in rotation.

Second, the shank should be capable of being reliably latched in its retracted position.

Third, the shank should be capable of being so latched with a small force.

Fourth, the shank should be reliably releasable from its latched position.

Fifth, the latch member should be free of fatigue and other defects for years.

With screwdrivers of the type described above, heretofore widely used, a latch pawl biased by a leaf spring is engaged in or disengaged from an annular groove formed in a rear end portion of the screwdriver shank to retain the shank in a latched state or alternatively in an automatic state.

To ensure the engagement or disengagement of the latch pawl, the leaf spring must have a biasing force sufficient to reliably release the latch pawl from the annular groove. However, when the spring has an increased elastic force, the latch pawl requires a greater force for engagement into the annular groove, and the spring, even if having an enhanced force, becomes fatigued and weakened during years of use, thus failing to assure a proper change-over action.

SUMMARY OF THE INVENTION

The above drawbacks have been overcome by the present invention which provides a screwdriver incorporating a latch pawl which is turnable by the rotation of a member mounted on a handle portion. The latch pawl, when turned, holds the screwdriver shank in its retracted position or releases the shank from the latched position without resorting to the use of a leaf spring.

The screwdriver of this invention comprises a hollow screwdriver main body, a screwdriver shank inserted in the main body slidably axially thereof while in rotation, a change-over ring rotatably fitted around a specified outer peripheral portion of the main body, a latch pawl provided between the change-over ring and the main body and adapted to engage an annular groove formed in the shank at a rear end portion thereof, and an engaging rod permitting the rotation of the change-over ring only when the shank has been slidably retracted to its innermost position. Thus, only when the shank is in its innermost retracted position can the latch pawl be engaged in the annular groove in the shank by rotating the change-over ring by a small force and thereby holding the shank against forward sliding movement. The latch pawl is disengaged from the shank by turning the change-over ring in the reverse direction, thus rendering the shank slidable.

DESCRIPTION OF THE PREFERRED EMBODIMENT

Figure 1:
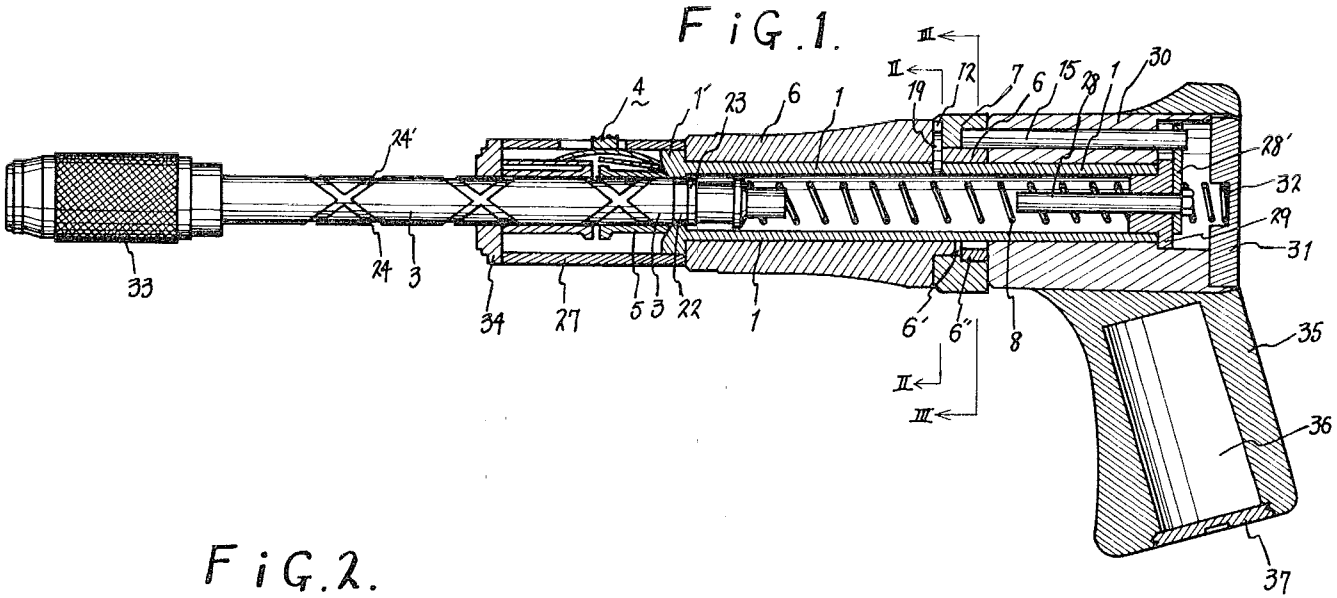
FIG. 1 is a side elevation view partly in vertical section taken along the centerline of a screwdriver to show the same in its automatic state.
Figure 3:
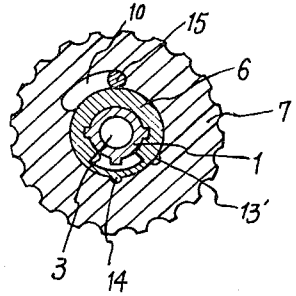
FIG. 3 is a view in cross section taken along the line III—III in FIG. 1.

The screwdriver shown in the drawings includes a hollow main body 1 provided with rotatable change-over means for operating the screwdriver selectively in an automatic state or in a latched state. The screwdriver main body 1 supports therein a screwdriver shank 3 which is axially slidable.

The periphery of shank 3 has helical grooves 24 and 24' therein and coextending in in right- and left-hand directions. Change-over tubes 5 are adjacent to each other, and engage the grooves 24 and 24' respectively, and are fitted around the portion of the shank 3 extending from the main body 1. A main body sleeve 27, surrounding the change-over tubes 5, is attached to the outer periphery of the front end of the main body 1. A ring 34 is attached to the open front end of the sleeve 27 to prevent the axial sliding of the change-over tubes 5.

Each of the change-over tubes 5 is provided with a ratchet wheel 5' on its outer periphery. A switch member 4, projecting outwardly from a slit 2 formed in the side wall of the sleeve 27, is fixedly provided with an elastic switch piece 26 on its inner end inside the sleeve 27. A pair of pawl plates 25 are adapted to be depressed by the switch piece 26 toward the ratchet wheels 5' and into engagement therewith to prevent the rotation of the wheels in one or the other direction, respectively. The main body 1 has at its front end an inwardly projecting flange 1' for preventing the deflection of the shank 3. The flange 1' engages a flange 23 at a rear end portion of the shank 3 to prevent the shank 3 from slipping further forward because of its forward bias at all times by a spring 8 located within the main body 1.

Figures 4, 5, 6, 7, 8:
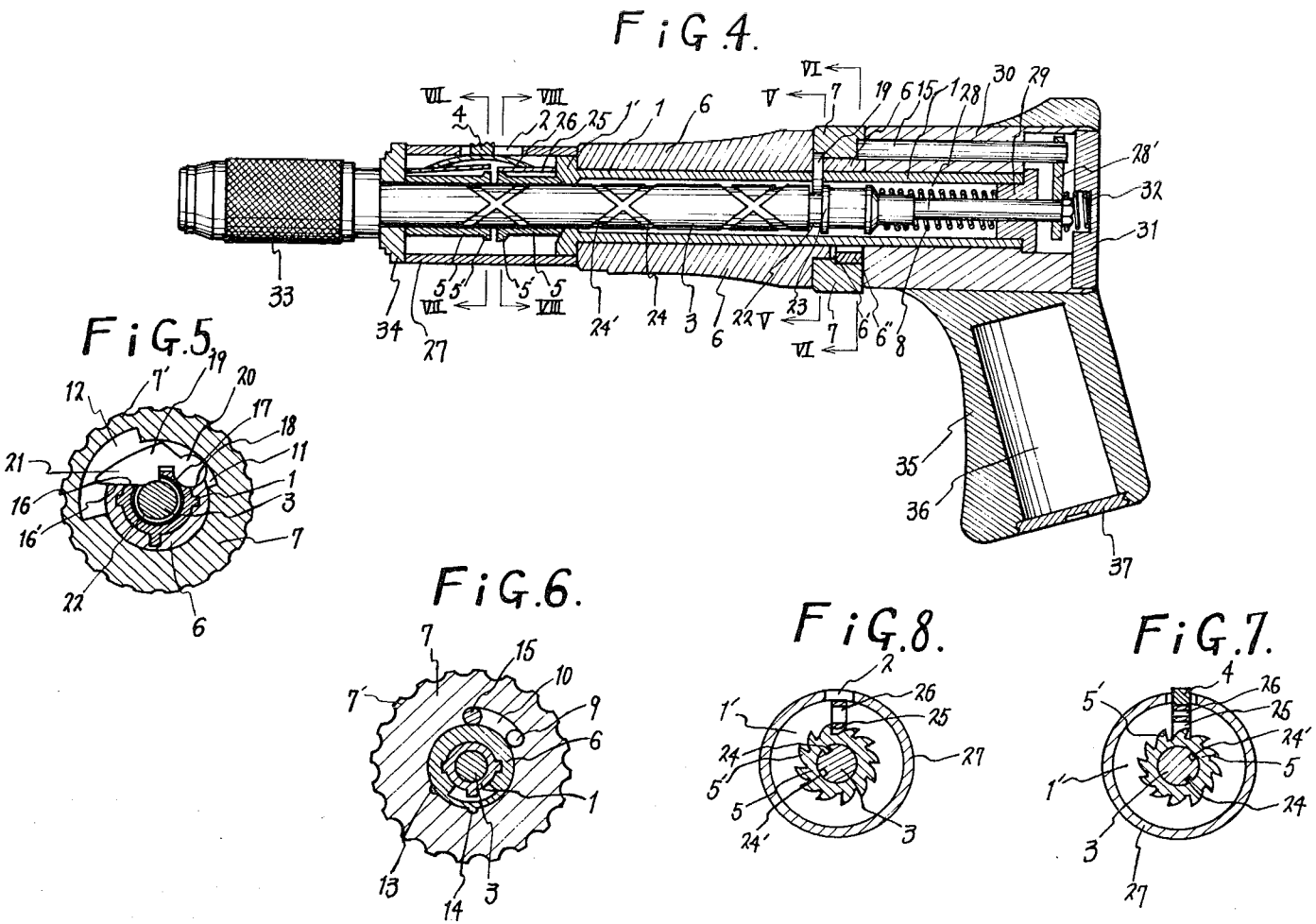
FIG. 4 is a view similar to FIG. 1 showing the screwdriver in its latched state.
FIG. 5 is a view in cross section taken along the line V—V in FIG. 4.
FIG. 6 is a view in cross section taken along the line VI—VI in FIG. 4.
FIG. 7 is a view in cross section taken along the line VII—VII in FIG. 4.
FIG. 8 is a view in cross section taken along the line VIII—VIII in FIG. 4.

An outer tube 6 covering the outer periphery of the front half of the main body 1 has at its rear end a recessed portion rotatably carrying a change-over ring 7, which is in the form of a short cylinder having a knurled outer periphery 7'. As seen in FIG. 5, the change-over ring 7 has in its front end surface with a circular arc recess 11, concentric with the ring 7, and another recess 12 communicating with the recess 11 and having a larger outer radius than the recess 11. With reference to FIG. 6, the change-over ring 7 is formed with an arcuate recess 10 in its rear end surface. The recess 10 is concentric with the ring 7. A deep cavity 9, is positioned at one end of the arcuate recess 10 for receiving the front end of an engaging rod 15. The change-over ring 7 has in its inner periphery small axial engaging grooves 13 and 13' spaced by a distance approximately equal to the length of the arcuate recess 10.

The outer tube 6 is formed, at a position close to its open rear end, with an aperture 6', which is parallel to the open rear end surface and has a specified length. The portion of the tube 6 between the aperture 6' and the open end face is elastic and has a reduced wall thickness. This portion serves as an elastic portion 6''. A small projection 14 is formed at the center of the portion 6''. Portion 6'' is parallel to the axis of the outer tube 6, and projection 14 engages either one of the grooves 13 or 13'. The engagement of the small projection 14 in either one of the grooves property retains the change-over ring 7 in that position.

The the screwdriver main body 1 and the outer tube 6 are respectively formed with apertures 16 and 16' positioned in the same vertical plane as the recess 12 to provide a space communicating with the shank 3. Further, in corresponding relation to the recess 11, the main body 1 and the outer tube 6 are formed with an arcuate groove 17 and an aperture 18 respectively. A latch pawl 19 has a disc-like base portion 20 which fits in the recess 11, the aperture 18 and the groove 17. A latch portion 21 extends from the base portion 20 through the apertures 16 and 16', and an inner side of portion 21 is engageable with an annular groove 22 formed in a rear end portion of the shank 3. The rotation of the change-over ring 7 in one direction causes a radial inner surface of the ring 7 defining the recess 12 to come into contact with the forward end of the latch portion 21 and to subsequently turn the latch portion 21 out of engagement with the annular groove portion 22.

When the ring 7 is rotated in the reverse direction, the inner surface of the ring 7, defining the recess 11, contacts and pushes the latch portion 21 which turns the portion 21 into the annular groove 22.

A handle 30 is fitted around the rear half of the main body 1. An engaging rod 15 axially extends through the handle 30, parallel to the main body 1 and has a front end engaging the arcuate recess 10. A support rod 28 axially extends along the main body 1 through a closure 29 closing the open rear end of the main body. has a A connecting member 28' connects the rear portion of the support rod 28 to the engaging rod 15.

A spring 32 is provided between the support rod 28 and a rear cover 31 which is fitted in the open rear end of the handle 30. The spring 32 acts to bias the support rod 28 and the engaging rod 15 forward at all times.

A chuck 33 is fixed to the front end of the shank 3 for gripping a bit and has a cross end or straight-edged end.

A grip portion 35 has a central cavity 36 (for accommodating bits). The cavity 36 is closed by a cover 37.

Figure 2:
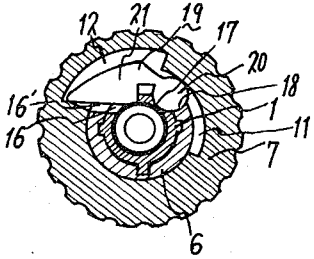
FIG. 2 is a view in cross section taken along the line II—II in FIG. 1.

The screwdriver of this invention having the foregoing construction will be used in the following manner. When the groove 13 in the inner periphery of the change-over ring 7 is in engagement with the small projection 14 on the outer tube 6, the engaging rod 15 is in its forward most biased position by the spring 32 and is in engagement with the cavity 9 of the ring 7, thereby holding the ring 7 against rotation. In this position the change-over ring 7 in turn holds the latch portion 21 out of engagement with the annular groove 22 because the radial inner surface of ring 7 abuts an inner portion of the latch 21 as best shown in FIG. 2. When the main body 1 in this state is pushed against a screw by the hand grasping the grip portion 35, the change-over tube 5, that is associated with the ratchet wheel 5' that is in engagement with one of the pawl plates 25, is held against rotation in one respective direction. However, the shank 3 can still rotate in the respective other direction and slide axially forward and backward whereby the screw can be respectively either tightened or loosened.

The operation can be changed over from tightening to loosening and vice versa by shifting the switch member 4 forward or backward to select the change-over tube 5 to be locked against rotation.

In this way, the shank 3 can be rotated in the desired direction by pushing the main body 1 axially thereof.

When the shank 3 is retracted toward its innermost position within the main body 1, the support rod 28 and the engaging rod 15 are moved against the action of the spring 32, and upon disengagement of the rod 15 from the cavity 9, the change-over ring 7 becomes rotatable.

When the ring 7 is rotated in one direction, an inner surface of the ring defining the recess 11 comes into contact with the latch portion 21 and turns the latch portion into engagement with the annular groove portion 22 of the shank 3. This prevents the axial sliding and therefore the rotating movement of the shank 3. In this state, the small projection 14 is in engagement with the groove 13'.

Accordingly, with the latch in this latched state, the user can either tighten or loosen a screw by simply rotating the grip portion 35 in the appropriate direction which in turn rotates the shank 3 via the outer tube 6 and the main body 1.

With the screwdriver of this invention described above, the shank can be pushed into the main body and caused, by the ratchet means, to rotate in only the desired direction. Only when the shank has been pushed in to its innermost position is the change-over ring rotatable to render the screwdriver selectively operable in an automatic or latched state. Since the locking means is used for the change-over without employing any leaf spring, the change-over action can be instituted reliably and with little force.

What we claim is:

1. A screwdriver operable in an automatic or latched state, said screwdriver comprising:

a screwdriver shank, said shank having a front and rear portion, a first helical groove extending along a portion of said shank, and an annular groove in the periphery of a segment of said rear portion;

a cylindrical main body surrounding a portion of said shank for supporting said shank and allowing axial and rotational movement relative thereto;

a closure member fixedly positioned inside the rear portion of said main body;

a first spring having one end abutting said closure member and the other end abutting said shank for spring biasing said shank forward relative to said main body;

a ratchet means for engaging said helical groove and preventing said relative rotational movement of said shank in one direction;

a locking means for locking said shank when it is in its most rearward position;

said locking means including:

a latch pawl for engaging said annular groove and thereby locking said shank;

a rotatable change-over ring in engagement with said latch pawl for, when said ring is rotated in one direction, causing said latch pawl to engage said annular groove and, when said ring is rotated in the other direction, causing said latch pawl to disengage said annular groove; and an engaging rod for engaging said ring when said shank is in other than its most rearward position and locking said locking means in a position whereby it is not engaging said annular groove.

2. A screwdriver as claimed in claim 1, said screwdriver further comprising:

an outer tube fitted around a portion of said main body, said outer tube having two apertures;

said main body having an arcuate groove and an aperture; and said locking means wherein:

said change-over ring slidably surrounds a portion of said outer tube and has a recessed portion formed in one end;

said recessed portion is concentric with said shank and is formed by a large and small space said ring having a large circular arc outer periphery and two radially spaced sidewalls for defining said large space, and having a small circular arc outer periphery and two radially spaced sidewalls for defining said small space, and wherein said spaces have a common radial sidewall;

said latch pawl having a disc-like base and a latch portion, said base being rotatably positioned within said arcuate groove of said main body, one of said apertures of said outer tube, and said outer periphery of said small space; and said latch portion extending from said base, projecting through the other said aperture of said outer tube and said aperture of said main body, positioned adjacent to said annular groove, and projecting into said large space, whereby, when said ring is rotated in one direction said outer periphery of said small space engages said latch portion thereby causing said base to rotate and said latch portion to engage said annular groove, and when said ring is rotated in the other direction one of said large space sidewalls engages said latch portion thereby causing said base to rotate and said latch portion to disengage said annular groove.

3. A screwdriver as claimed in claim 2, said screwdriver further comprising:

a handle surrounding a portion of said main body and abutting said change-over ring;

a rear cover attached to said handle and closing the rear end of said screwdriver;

a support rod concentric and engageable with said rear portion of said shank and axially slidably extending through said closure member;

a second spring having one end abutting said rear cover and the other end abutting said support rod for spring biasing forward said support rod;

said locking means wherein:

an arcuate recess is formed in the other end of said change-over ring for slidably engaging said engaging rod; and said recess having a deep cavity portion for engaging said engaging rod and thereby preventing rotational movement of said change-over ring; and a connecting member for fixedly connecting said engaging rod to said support rod and thereby preventing said support rod from sliding through said closure member, whereby, when said shank is in its most rearward position said support rod is in its most rearward position thereby causing said engaging rod to disengage from said cavity portion.

4. A screwdriver as claimed in claim 3, wherein said support rod is substantially parallel to said engaging rod.

5. A screwdriver as claimed in claim 2, wherein:

said outer tube includes an arcuate elastic portion having a reduced inward radial thickness and having a small outward projection at substantially the center of its circumference; and said change-over ring having two small engaging grooves spaced apart on its inner periphery for respectively engaging said projection and thereby preventing said ring from readily rotating.

* * * * *